US010774667B2

(12) United States Patent
Eldrid et al.

(10) Patent No.: US 10,774,667 B2
(45) Date of Patent: Sep. 15, 2020

(54) STEAM TURBINE AND METHODS OF ASSEMBLING THE SAME

(71) Applicant: General Electric Company, Schenectady, NY (US)

(72) Inventors: Sacheverel Quentin Eldrid, Saratoga Springs, NY (US); Thomas Joseph Farineau, Schoharie, NY (US); Michael Earl Montgomery, Niskayuna, NY (US); Timothy Scott McMurray, Fultonville, NY (US); Xiaoqing Zheng, Niskayuna, NY (US)

(73) Assignee: General Electric Company, Schenectady, NY (US)

( * ) Notice: Subject to any disclaimer, the term of this patent is extended or adjusted under 35 U.S.C. 154(b) by 500 days.

(21) Appl. No.: 15/484,819

(22) Filed: Apr. 11, 2017

(65) Prior Publication Data

US 2017/0218786 A1 Aug. 3, 2017

Related U.S. Application Data

(62) Division of application No. 14/098,997, filed on Dec. 6, 2013, now Pat. No. 9,702,261.

(51) Int. Cl.
*F01D 11/08* (2006.01)
*F01D 11/00* (2006.01)
(Continued)

(52) U.S. Cl.
CPC ..... *F01D 11/08* (2013.01); *F01D 1/02* (2013.01); *F01D 1/023* (2013.01); *F01D 9/06* (2013.01);
(Continued)

(58) Field of Classification Search
CPC ..... F01D 11/001; F01D 11/02; F01D 11/04; F01D 9/06; F01D 9/065; F01D 1/02;
(Continued)

(56) References Cited

U.S. PATENT DOCUMENTS 3,692,429 A 9/1972 Redding
4,545,725 A * 10/1985 Ikeda ..... F01D 11/04 415/117
(Continued)

FOREIGN PATENT DOCUMENTS

DE 4411616 A1 10/1995
DE 19620828 C1 9/1997
(Continued)

*Primary Examiner* — Christopher Verdier
(74) *Attorney, Agent, or Firm* — Armstrong Teasdale LLP

(57) ABSTRACT

A steam turbine is provided. The steam turbine includes a housing, a first steam inlet configured to discharge a first steam flow within the housing, and a second steam inlet configured to provide a second steam flow. A rotor and stator are coupled to the housing and configured to form a first flow path therebetween and in flow communication with the first steam flow. The rotor includes a plurality of blades coupled to the rotor, at least one root of the plurality of blades has a first side, a second side and a passageway coupled in flow communication to the first side and the second side. The passageway is configured to receive the second steam flow within the at least one root. The at least one root includes an angel wing configured to seal the second steam flow from the first flow path.

19 Claims, 11 Drawing Sheets

(51) Int. Cl.
*F01D 1/02* (2006.01)
*F01D 9/06* (2006.01)
*F01D 11/04* (2006.01)

(52) U.S. Cl.
CPC ..... *F01D 11/001* (2013.01); *F01D 11/04* (2013.01); *F05D 2230/60* (2013.01); *F05D 2240/55* (2013.01); *Y10T 29/49323* (2015.01)

(58) Field of Classification Search
CPC ..... F01D 1/04; F01D 1/023; F05D 2230/60; F05D 2240/55; F05D 2220/31; Y10T 29/49323; Y10T 29/49321
USPC ..... 415/93, 99–103, 106, 107, 108, 174.5, 415/173.7, 173.5, 173.4, 115, 116; 416/198 A, 199, 201 R
See application file for complete search history.

(56) References Cited

U.S. PATENT DOCUMENTS 5,125,794 A 6/1992 Detanne
5,593,273 A 1/1997 Brinkman
5,833,244 A 11/1998 Salt et al.
6,010,302 A 1/2000 Oeynhausen
6,397,604 B2 6/2002 Eldrid et al.
6,428,270 B1 8/2002 Leone et al.
7,003,956 B2 2/2006 Yamashita et al.
7,101,144 B2 9/2006 Haje et al.
7,488,153 B2 2/2009 Reigl
7,635,250 B2 12/2009 Montgomery et al.
9,702,261 B2 * 7/2017 Eldrid ..... F01D 11/001
2006/0104811 A1 5/2006 Montgomery et al.
2007/0065273 A1 3/2007 Cornell
2008/0003100 A1 1/2008 Laurer et al.
2009/0285670 A1 11/2009 Rivas et al.
2011/0085886 A1 4/2011 Kasibhotla et al.
2011/0085905 A1 * 4/2011 Willett ..... F01D 5/084 416/1
2011/0158819 A1 6/2011 Mani et al.

FOREIGN PATENT DOCUMENTS

DE 19617539 B4 2/2006
EP 1452688 A1 9/2004

* cited by examiner

STEAM TURBINE AND METHODS OF ASSEMBLING THE SAME

CROSS REFERENCE TO RELATED APPLICATIONS

This application is a divisional application and claims priority to U.S. patent application Ser. No. 14/098,997, filed Dec. 6, 2013, for "STEAM TURBINE AND METHODS OF ASSEMBLING THE SAME," now issued as U.S. Pat. No. 9,702,261, which is hereby incorporated by reference in its entirety.

BACKGROUND OF THE INVENTION

The embodiments described herein relate generally to steam turbines, and more particularly, to methods and systems for cooling turbine components of the steam turbine.

As steam turbines rely on higher steam temperatures to increase efficiency, steam turbines should be able to withstand the higher steam temperatures so as not to compromise the useful life of the turbine. During a typical turbine operation, steam flows from a steam source through an inlet in a housing to flow parallel to an axis of rotation along an annular hot steam path. Typically, turbine stages are disposed along the steam path such that the steam flows through vanes and blades of subsequent turbine stages. The turbine blades may be secured to a plurality of turbine wheels, with each turbine wheel being mounted to or integral to the rotor shaft for rotation therewith. Alternatively, the turbine blades may be secured into a drum type turbine rotor rather than individual wheels, with the drum integral with the shaft.

Conventionally, turbine blades may include an airfoil extending radially outwardly from a substantially planar platform and a root portion extending radially inwardly from the platform. The root portion may include a dovetail or other means to secure the blade to the turbine wheel of the turbine rotor. In general, during operation of the steam turbine, steam flows over and around the airfoil of the turbine blade, which is subject to high thermal stresses. These high thermal stresses may limit the service life of the turbine blades. Moreover, the blade root and adjacent rotor may experience high thermal temperatures and stresses from the steam flow. Conventional steam turbines may use blade and rotor body materials that are more temperature resistant. These temperature resistant materials, however, may increase the cost of the turbine blades.

BRIEF DESCRIPTION OF THE INVENTION

In one aspect, a steam turbine is provided. The steam turbine includes a housing and a first steam inlet coupled in flow communication to the housing which is configured to discharge a first steam flow within the housing. A second steam inlet is configured to provide a second steam flow. A stator is coupled to the housing and includes plurality of vanes. A rotor is coupled to the housing and located within the stator, wherein the rotor and the stator are configured to form a first flow path there between and in flow communication with the first steam flow. The rotor includes a plurality of blades coupled to the rotor, wherein at least one root of the plurality of blades has a first side, a second side and a passageway coupled in flow communication to the first side and the second side. The passageway is configured to receive the second steam flow within the at least one root. The at least one root of the plurality of blades includes an angel wing configured to seal the second steam flow from the first flow path.

In another aspect, a rotor assembly is provided. The rotor assembly is coupled to a housing and located within a stator of a steam turbine. The rotor assembly includes a rotor coupled to the housing and has a first flow path configured to receive a first steam flow. A plurality of blades is coupled to the rotor, wherein at least one root of the plurality of blades has a first side, a second side and a passageway coupled in flow communication to the first side and the second side. The passageway is configured to receive a second steam flow. The at least one root of the plurality of blades includes an angel wing configured to seal the second steam flow from the first flow path.

In yet another aspect, a method of assembling a steam turbine is provided. The method includes coupling a stator to a housing and coupling a first steam inlet in flow communication to the housing. The method further includes forming a first flow path within the housing and in flow communication with the first steam inlet, and configuring a second steam inlet to provide a second steam flow. A rotor is coupled to the housing and within the stator. The rotor includes a plurality of blades coupled to the rotor. At least one root of the plurality of blades has a first side, a second side and a passageway coupled in flow communication to the first side and the second side. The passageway is configured to receive the second steam flow within the at least one root. The at least one root of the plurality of blades includes an angel wing configured to seal the second steam flow from the first flow path.

DETAILED DESCRIPTION OF THE INVENTION

The embodiments described herein relate generally to steam turbines. More particularly, the embodiments relate to methods and systems for facilitating fluid flow within turbine components of the steam turbine. It should be understood that the embodiments described herein for component cooling are not limited to turbine blades, and further understood that the description and figures that utilize a steam turbine and blades are exemplary only. Moreover, while the embodiments illustrate the steam turbine and blades, the embodiments described herein may be included in other suitable turbine components. Additionally, it should be understood that the embodiments described herein relating to flow paths need not be limited to turbine components. Specifically, the embodiments may generally be used in any suitable article through which a medium (e.g., water, steam, air, fuel and/or any other suitable fluid) is directed for cooling a surface of the article and/or for maintaining the temperature of the article.

Figure 1:
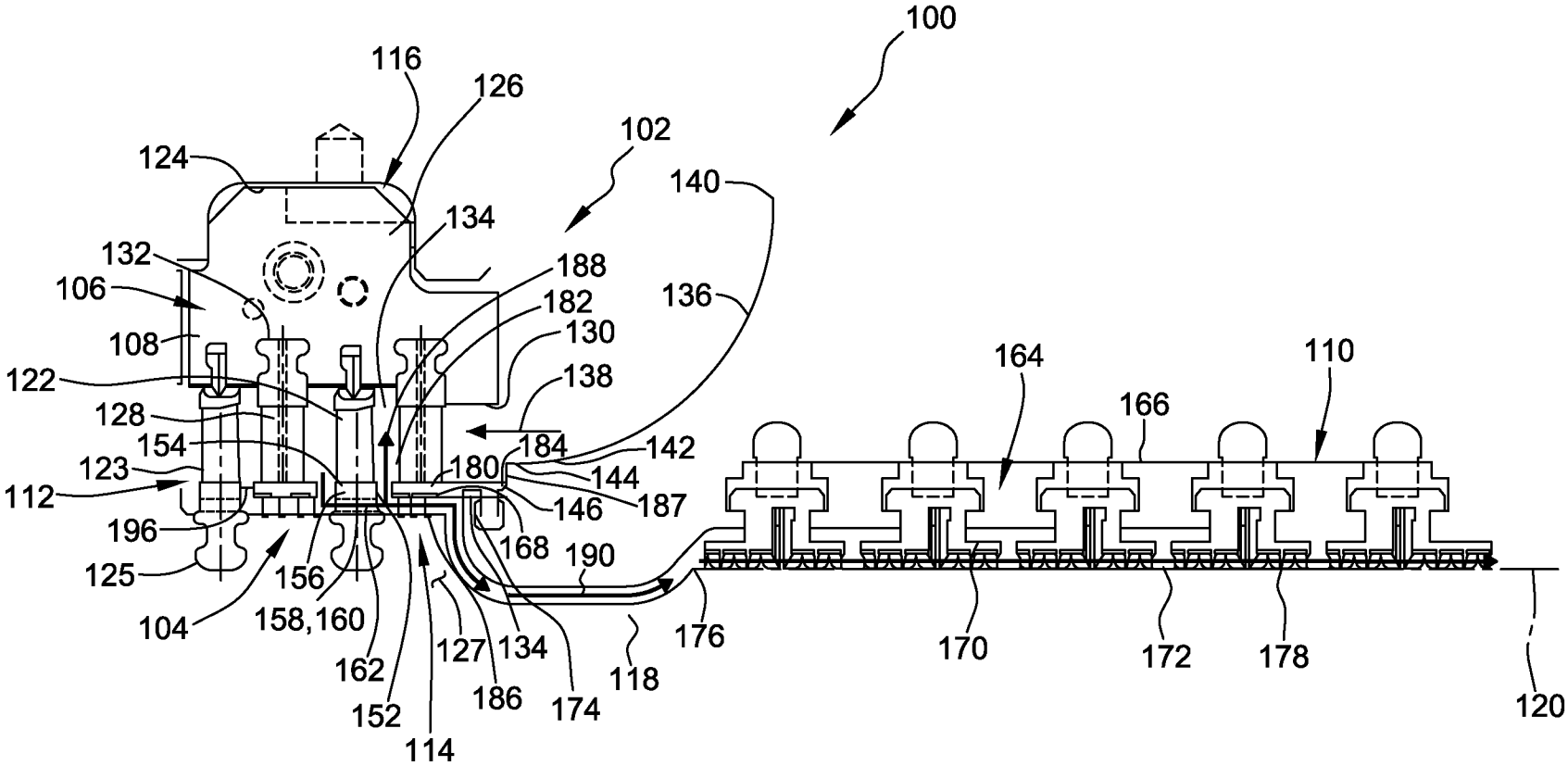
FIG. 1 is a side elevational view of an exemplary steam turbine and an exemplary flow assembly coupled to the steam turbine.
Figure 2:
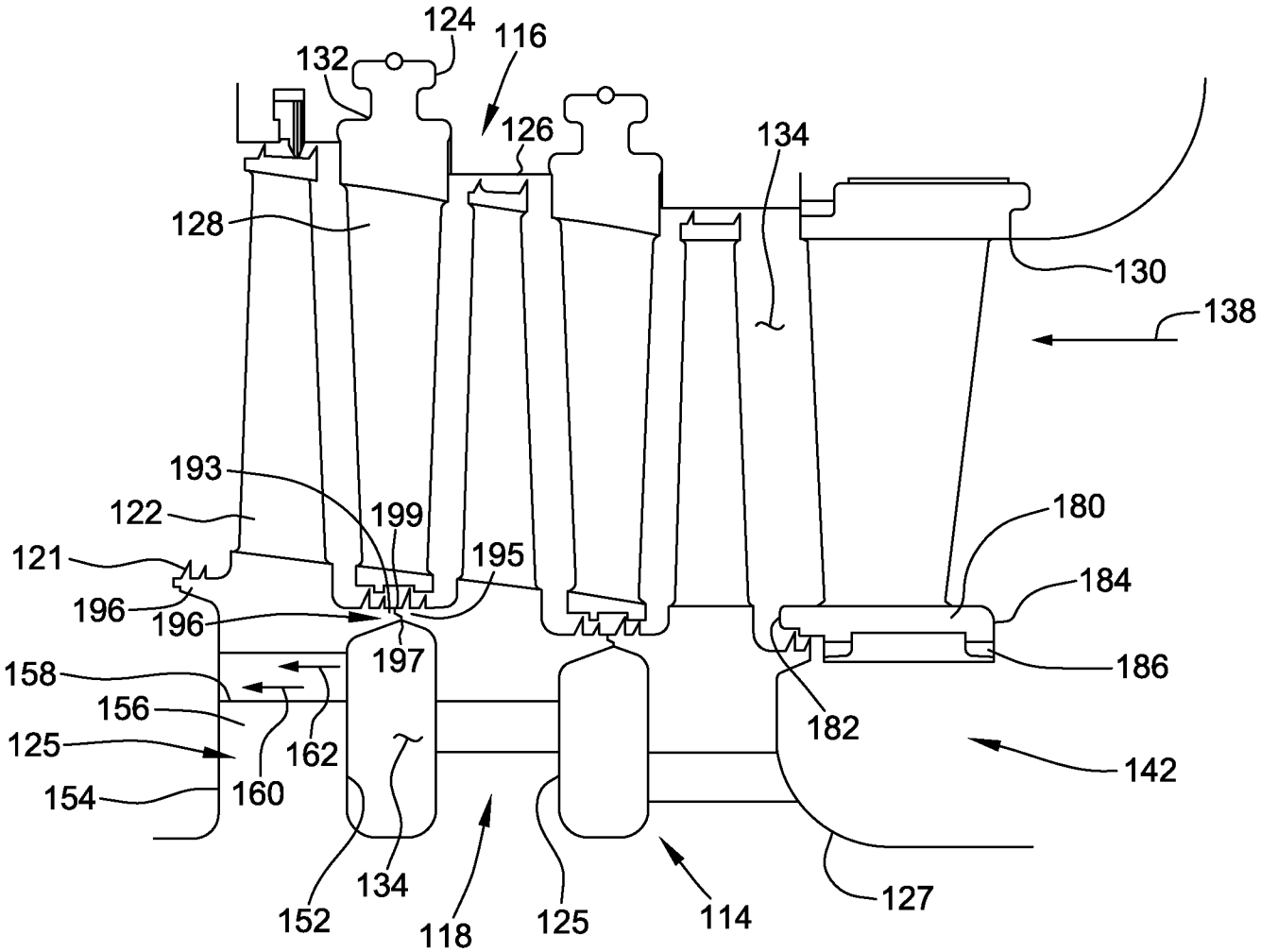
FIG. 2 is a partial view of the flow assembly shown in FIG. 1.

FIG. 1 illustrates a side elevational view of a steam turbine 100 and a flow assembly 102 coupled to steam turbine 100. FIG. 2 is a partial view of flow assembly 102 shown in FIG. 1. In the exemplary embodiment, steam turbine 100 includes a high pressure, single flow turbine with a negative root reaction cooling configuration 104. Alternatively, steam turbine 100 may include any pressure and flow configuration to enable steam turbine 100 to function as described herein. Steam turbine 100 includes a plurality of pressurized sections 106. More particularly, steam turbine 100 includes a high pressure section 108 and an intermediate pressure section 110. High pressure section 108 includes a plurality of stages 112 in a facing and spaced relationship with respect to each other. Each stage 12 includes a rotating assembly 114 and a stationary assembly 116. In each stage 112, rotating assembly 114 includes a rotor 118 disposed axially about an axis of rotation 120 of steam turbine 100.

A plurality of blades 122 is coupled to rotating assembly 114 at platforms, wherein blades 122 extend radially outward from platforms 123 and toward stationary assembly 116. Blades 122 include a pair of opposing angel wings 196 radially extending from opposing blade sides. Angel wings 196 include seals 121 such as, but not limited to brush seals, which extend toward stationary assembly 116. Moreover, adjacent angel wings 196, such as but not limited to, angel wing 193 and angel wing 195, are configured in a sealable configuration to facilitate providing a seal between angel wing 193 and angel wing 195 while providing rotational movement of angel wing 193 and angel wing 195 with respective blade roots 125. More particularly, angel wing 193 includes a first overlapping portion 197 and angel wing 195 includes a second overlapping portion 199 which is removably coupled to first overlapping portion 197. Portions 197 and 199 are configured to reduce and/or eliminate flow communication of first flow path 130 with blade roots 125. A plurality of blade roots 125 is coupled to rotor 118. Blade roots 125 include a dovetail configuration such as, but not limited to, a tangential dovetail and/or an axial dovetail configuration. Blade root 125 can include any dovetail configuration to enable steam turbine 100 to function as described herein. Roots 125 are configured to couple blades 122 to a turbine wheel or a rotor body 127 of rotor 118. Angel wings 196, blade roots 125, and rotor body 127 are configured to define a cooling passage 134 between blade roots 125.

Stationary assembly 116 includes a housing 124, a stator 126 and a plurality of stationary vanes 128. Stationary vanes 128 include an end cover 180 facing rotor body 127. Housing 124 is configured to enclose at least one of rotor 118, blades 122, stator 126 and vanes 128. In the exemplary embodiment, rotor 118 and stator 126 are configured in a spaced relationship to define a first flow path 130 there between and within housing 124. Vanes 128 are coupled in a plurality of slots 132 of stator 126 and arranged in circumferential stages that are located between stages of blades 122.

Stationary assembly 116 further includes a steam inlet 136 coupled in flow communication to first flow path 130. Steam inlet 136 is configured to channel or route a first steam flow 138 at high pressures and high temperatures toward first flow path 130 and in flow communication with the plurality of blades 122. In the exemplary embodiment, steam inlet 136 is located within housing 124 and is in flow communication with a steam source 140 such as, for example, a boiler or heat recovery steam generator. Steam inlet 136 further includes a bowl area 142 having a bowl insert 144 and a leakage flow path 146. Bowl insert 144 is coupled in flow communication to first flow path 130 and rotor 118.

In the exemplary embodiment, at least one root 125 of the plurality of roots 125 includes a first side 152, a second side 154 and a body 156 located there between. First side 152 is located upstream from second side 154 with respect to first steam flow 138. Moreover, first side 152 and second side 154 are configured in flow communication to respective cooling passages 134. Root 125 further includes a passageway 158 defined within body 156 and coupled in flow communication to first side 152 and second side 154. Moreover, passageway 158 is configured in flow communication to cooling passages 134. In the exemplary embodiment, passageway 158 defines a second flow path 160 within root 125 and in flow communication to cooling passages 134. Cooling passage 134 and second flow path 160 define a cooling circuit of rotor 118. Second flow path 160 is configured to facilitate discharging a second steam flow 162 within root 125 and into cooling passages. Angel wings 196 and/or end cover 180 are configured to facilitate minimizing and/or eliminating flow communication between cooling passages 134 and first flow path 138. More particularly, adjacent angel wings 196 are configured to facilitate directing second steam flow 162 from root 125, through cooling passage 134, and into adjacent blade roots 125 to facilitate enhancing cooling of blade roots 125 and/or rotor body 127. In the exemplary embodiment, first flow path 130 and second flow path 160 are configured in negative root reaction configuration 104 as described herein.

Rotating assembly 114 further includes a seal assembly 164 coupled to rotor 118. Seal assembly 164 includes a first seal member 166 and a second seal member 168. In the exemplary embodiment, first seal member 166 includes a packing head 170, which is coupled to rotor 118 at an upstream position from steam inlet 136. Moreover, packing head 170 includes a third flow path 172 having a first end 174 coupled in flow communication to second flow path 160 and a second end 176 coupled in flow communication to intermediate pressure section 110. A plurality of packing rings 178 is located within third flow path 172. Second seal member 168 includes cover 180 coupled to at least one vane 128 and located between vane 128 and rotor 118. Cover 180 includes a first end 182 extending into cooling passage 134 and a second end 184 extending into bowl area 142. More particularly, second end 184 is coupled and arranged in flow communication to bowl insert 144. In the exemplary embodiment, a seal 186 is coupled to cover 180 and extends toward angel wings 196 and located between second flow path 160 and third flow path 172.

Steam flow that does not perform work by flowing through the plurality of blades 122 and rotating rotor 118 is considered leakage fluid. Leakage fluid that does not perform work in a steam turbine 100 results in a loss output. First seal member 166 and second seal member 168 are configured to reduce steam flow between rotor 118 and packing head 170 to facilitate reducing output loss. More particularly, first seal member 166 and second seal member 168 are configured to reduce the volume of leakage fluids, so more fluid performs work by rotating rotor 118 in steam turbine 100.

During an exemplary operation, first steam flow 138, at high pressures and high temperatures, is directed from steam source 140, through steam inlet 136 and toward first flow path 130. More particularly, first steam flow 138 is directed toward the plurality of blades 122 and the plurality of vanes 128. As first steam flow 138 contacts the plurality of blades 122, first steam flow 138 rotates the plurality of blades 122 and rotor 118. First steam flow 138 passes through stages 112 in a downstream direction and continues through successive plurality of stages (not shown) in a similar manner.

As first steam flow 138 flows from steam inlet 136 and through first flow path 130, first steam flow 138 is configured to flow past the plurality of blades 122 and the plurality of vanes 128. Due to a negative root reaction, a temperature of first steam flow 138 at second side 154 of root 125 is different than a temperature of first steam flow 138 at first side 152. In the exemplary embodiment, the temperature at second side 154 is cooler than first side 152 of root 125 but a pressure of first steam flow 138 at second side 154 of root 125 is higher than a pressure of first steam flow 138 at first side 152 of root 125. First steam flow 138 at second side 154 of root 125 at a higher pressure than first side 152 of root 125 is used to force cooler steam as second steam flow 162 into second flow path 160. More particularly, first steam flow 138, based at least on pressure and temperature differentials on upstream and downstream sides of blades 122, is configured to back feed second steam flow 162 through second flow path 160. Second flow path 160 is configured to receive second steam flow 162 and direct second steam flow 162 within root 125 and out of first side 152. As cooler steam of second steam flow 162 moves through second flow path 160, heat of root 125 and/or rotor body 127 is transferred to second steam flow 162 to facilitate cooling root 125 and/or rotor body 127.

Angel wings 196 and seal 186 of cover 180 are configured to reduce and/or eliminate leakage of a first portion 188 of second steam flow 162 that exits second side 154, flows into cooling passage 134 and to reduce and/or eliminate mixing with first steam flow 138 in first flow path 130. A second portion 190 of second steam flow 162 moves between cover 180 and rotor 118 and either through packing rings 186 or to flow and mix with bowl insert steam flow 187. Second portion 190 is configured to flow through third flow path 172 and within packing head 170 for further use by at least one of reheat section (not shown) and/or low pressure section (not shown). In the exemplary embodiment, second portion 190 moves within intermediate pressure section 110 to facilitate controlling the pressure of steam flow across sealing members 178 to control the amount of steam leakage flowing through packing head 170.

Figure 3:
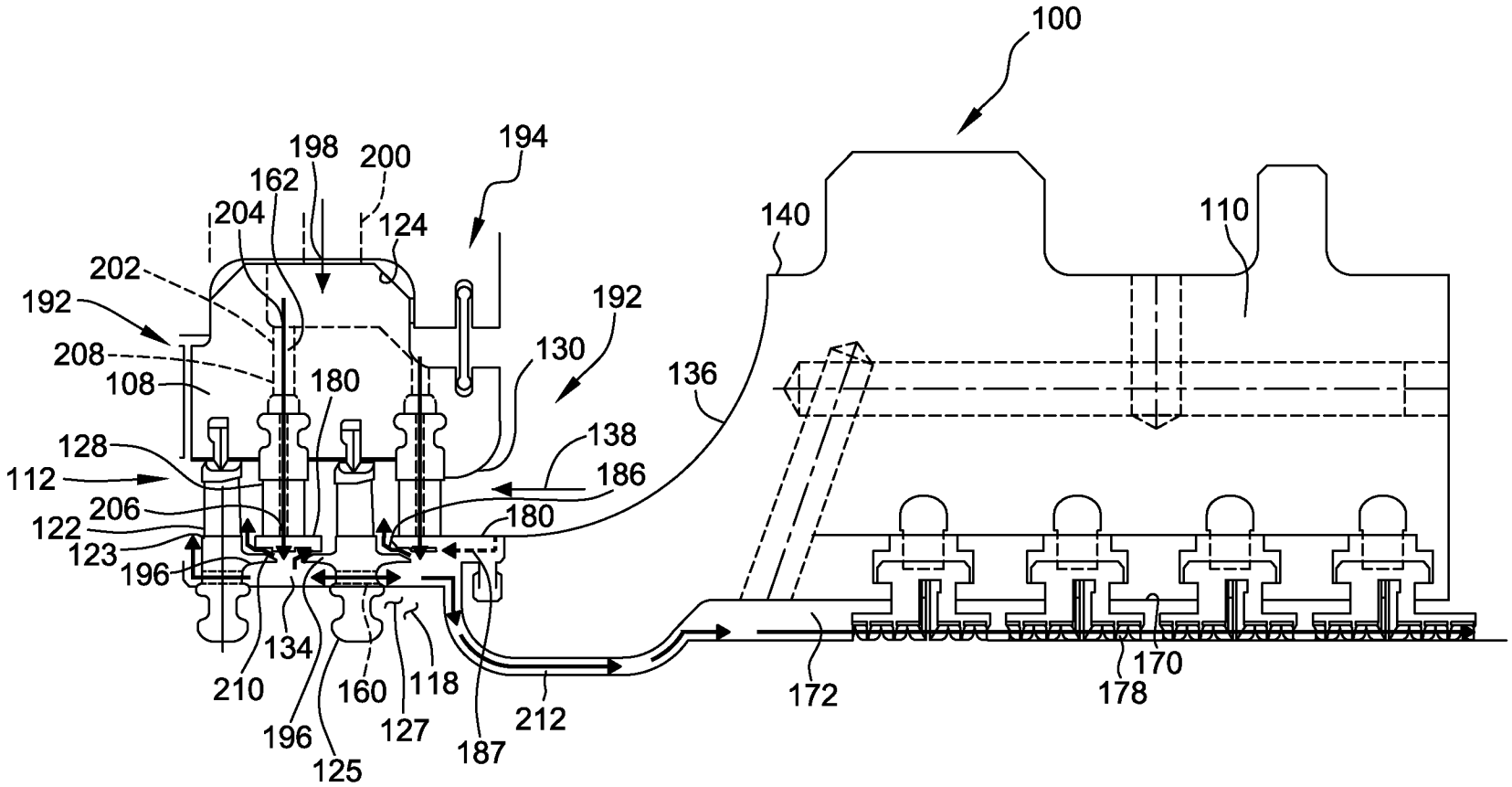
FIG. 3 is a side elevational view of another exemplary steam turbine and another exemplary flow assembly coupled to the steam turbine.

FIG. 3 is a cross sectional view of another flow assembly 192 coupled to steam turbine 100. In FIG. 3, similar components include similar element numbers as shown in FIGS. 1-2. Steam turbine 100 includes a high pressure, single flow turbine having an external cooling configuration 194. Alternatively, steam turbine 100 may include any pressure and flow configuration to enable steam turbine 100 to function as described herein. Steam turbine 100 includes high pressure section 108 and section 110. Moreover, angel wings 196 extend into opposing cooling passages 134.

In the exemplary embodiment, steam inlet 136 is coupled in flow communication to first flow path 130. Moreover, another steam inlet 198 is coupled to housing 124 and located external to housing 124. More particularly, steam inlet 198 is coupled to an external steam source 200 such as, for example, a boiler or a heat recovery steam generator, typically with steam temperatures below that of first steam flow 138. Steam inlet 198 is coupled in flow communication to at least one vane 128. In the exemplary embodiment, vane 128 includes a radial flow path 202 having a first end 204, a second end 206 and a passageway 208 coupled to and extending there between. First end 204 is coupled in flow communication to steam inlet 198 and second end 206 is coupled in flow communication to cooling passages 134. Steam inlet 198 is configured to direct second steam flow 162 from external steam source 200 and into housing 124. More particularly, first end 204 is configured to receive second steam flow 162 from steam inlet 198 and direct second steam flow 162 through radial flow path 202. Second end 206 is configured to direct second steam flow 162 into cooling passages 134.

During an exemplary operation, first steam flow 138, at high pressures and high temperatures, is directed from steam source 140, through steam inlet 136 and toward first flow path 130. More particularly, first steam flow 138 is directed toward the plurality of blades 122 and the plurality of vanes 128. As first steam flow 138 contacts the plurality of blades 122, first steam flow 138 rotates the plurality of blades 122 and rotor 118. First steam flow 138 passes through stages 112 in a downstream direction and continues through successive plurality of stages (not shown) in a similar manner.

Moreover, second steam flow 162, at lower temperatures and pressures than first steam flow 138, moves from first end 204, through radial flow path 202 and out of second end 206. As second steam flow 162 moves through passageway 208, heat of vanes 128 is transferred to second steam flow 162 to facilitate cooling vanes 128. Second steam flow 162 exits second end 206 and flows into cooling passage 134 at a temperature that is less than first steam flow 138. More particularly, a first portion 210 of second steam flow 162 moves between angel wings 196 and vanes 128 to facilitate cooling roots 125 and rotor body 127. Angel wings 196 and/or seal 186 of cover 180 are configured to reduce and/or eliminate leakage of first portion 210 of second steam flow 162 that exits second end 206, flows into cooling passage 134 and mixes with first steam flow 138 in first flow path 130. Alternatively, angel wings 196 and/or seal 186 can be configured to facilitate second steam flow 162 within cooling passage 134 mixing with first steam flow 138 in first flow path 130. A second portion 212 of second steam flow 162 is configured to flow into second flow path 160. As the cooler steam of second steam flow 162 moves through second flow path 160, heat is transferred from root 125 and/or root body 127 to second steam flow 162 to facilitate cooling root 125 and/or rotor body 127.

Second portion 212 of second steam flow 162 moves between cover 180 and rotor 118 and either through seal 186 or to flow and mix with bowl insert steam flow 187 depending on cooling intent. Second portion 212 is configured to flow through third flow path 172 and within packing head 170 for further use by at least one of reheat section (not shown) and/or low pressure section (not shown). In the exemplary embodiment, second portion 212 moves within intermediate pressure section 110 to facilitate controlling the pressure of steam flow across sealing members 178 to control the amount of steam leakage flowing through packing head 170.

Figure 4:
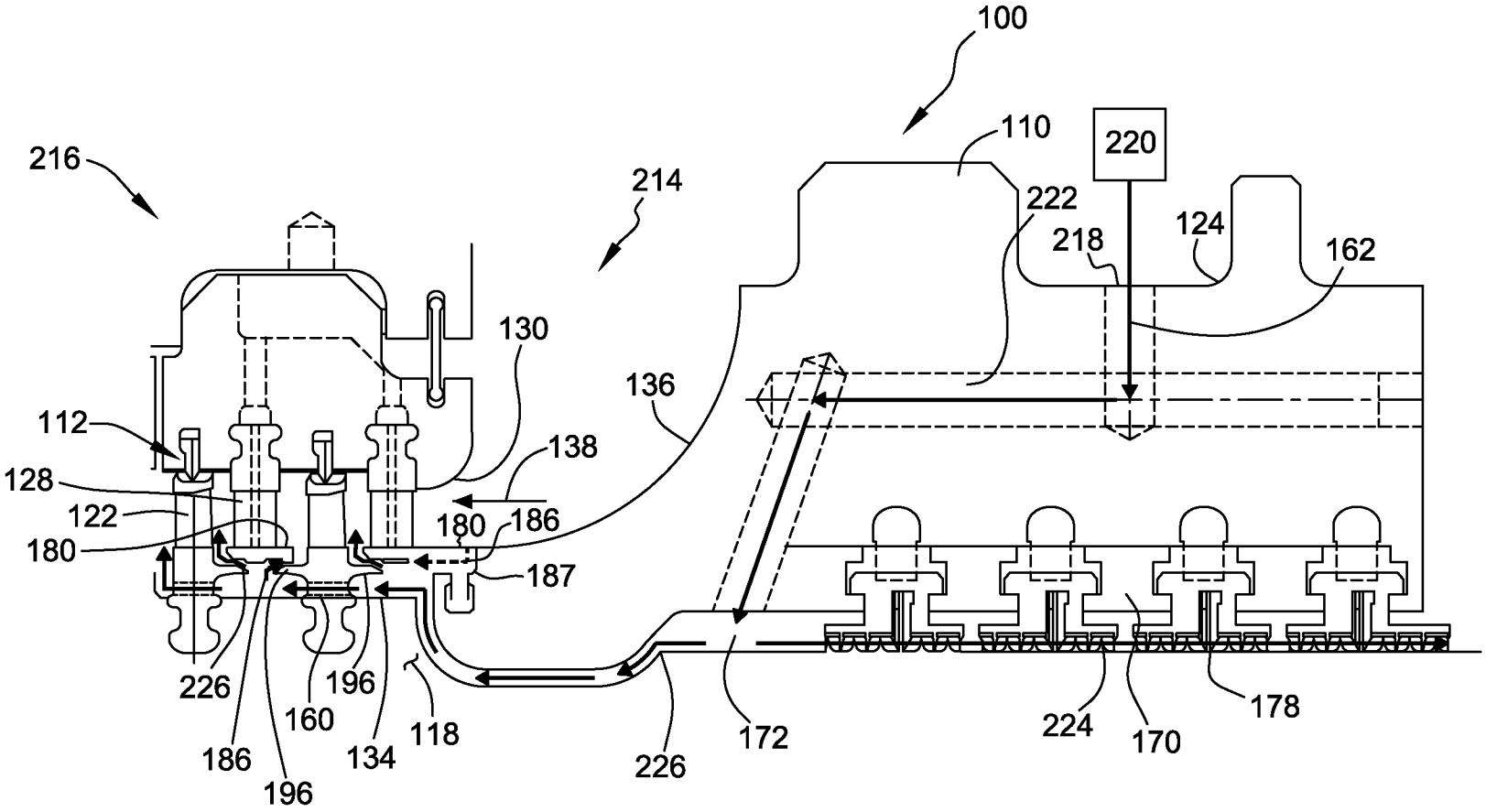
FIG. 4 is a side elevational view of another exemplary steam turbine and another exemplary flow assembly coupled to the steam turbine.

FIG. 4 is a cross sectional view another flow assembly 214 coupled to steam turbine 100. In FIG. 4, similar components include the same element numbers as FIGS. 1-3. Steam turbine 100 includes a high pressure, single flow turbine having an external cooling configuration 216. Alternatively, steam turbine 100 may include any pressure and flow configuration to enable steam turbine 100 to function as described herein. In the exemplary embodiment, steam inlet 136 is coupled in flow communication to first flow path 130. Moreover, another steam inlet 218 is coupled to packing head 170 and located external to housing 124. More particularly, steam inlet 218 is coupled to an external steam source 220. In the exemplary embodiment, steam inlet 218 is further coupled in flow communication to section 110. More particularly, steam inlet 218 is coupled in flow communication to packing head 170. Packing head 170 includes a packing flow path 222 coupled in flow communication to steam inlet 218 and third flow path 172.

During an exemplary operation, first steam flow 138, at high pressures and high temperatures, is directed through steam inlet 136 and toward first flow path 130. More particularly, first steam flow 138 is directed toward the plurality of blades 122 and the plurality of vanes 128. As first steam flow 138 contacts the plurality of blades 122, first steam flow 138 rotates the plurality of blades 122 and rotor 118. First steam flow 138 passes through stages 112 in a downstream direction and continues through successive plurality of stages (not shown) in a similar manner.

Moreover, second steam flow 162, at lower temperatures and pressures than first steam flow 138, moves from steam inlet 218 and into packing flow path 222. Second steam flow 162 moves through packing flow path 222 and a first portion 224 of second steam flow 162 moves into third flow path 172 and through packing rings 178 that are located within third flow path 172. First portion 224 moves through packing head 170 for further use by at least one reheat section (not shown) and/or a low pressure section (not shown). First portion 224 moves within intermediate pressure section 110 to facilitate controlling the pressure of steam flow across sealing members 178 to control the amount of steam leakage flowing through packing head 170.

A second portion 226 of second steam flow 162 moves through third flow path 172 and toward rotor 118. Second portion 226 flows and mixes with bowl insert steam flow 187. Second portion 226 flows between cover 180 and rotor 118 and through packing rings 186. Second portion 226 exits packing rings 186 and flows into cooling passage 134 at a pressure that is less than first steam flow 138. More particularly, second portion 226 flows between angel wings 196 and vanes 128. Angel wings 196 and/or cover 180 are configured to reduce and/or eliminate leakage of second steam flow 162 that flows into cooling passage 134 and mixes with first steam flow 138 in first flow path 130. Alternatively, angel wings 196 and/or cover 180 can be configured to facilitate second steam flow 162 within cooling passage 134 mixing with first steam flow 138 in first flow path 130. Second portion 226 of second steam flow 162 is also configured to flow into second flow path 160. As the cooler steam of second portion 226 moves through second flow path 160, heat of root 125 and/or rotor body 127 is transferred to second portion 226 to facilitate cooling root 125 and/or rotor body 127.

Figure 5:
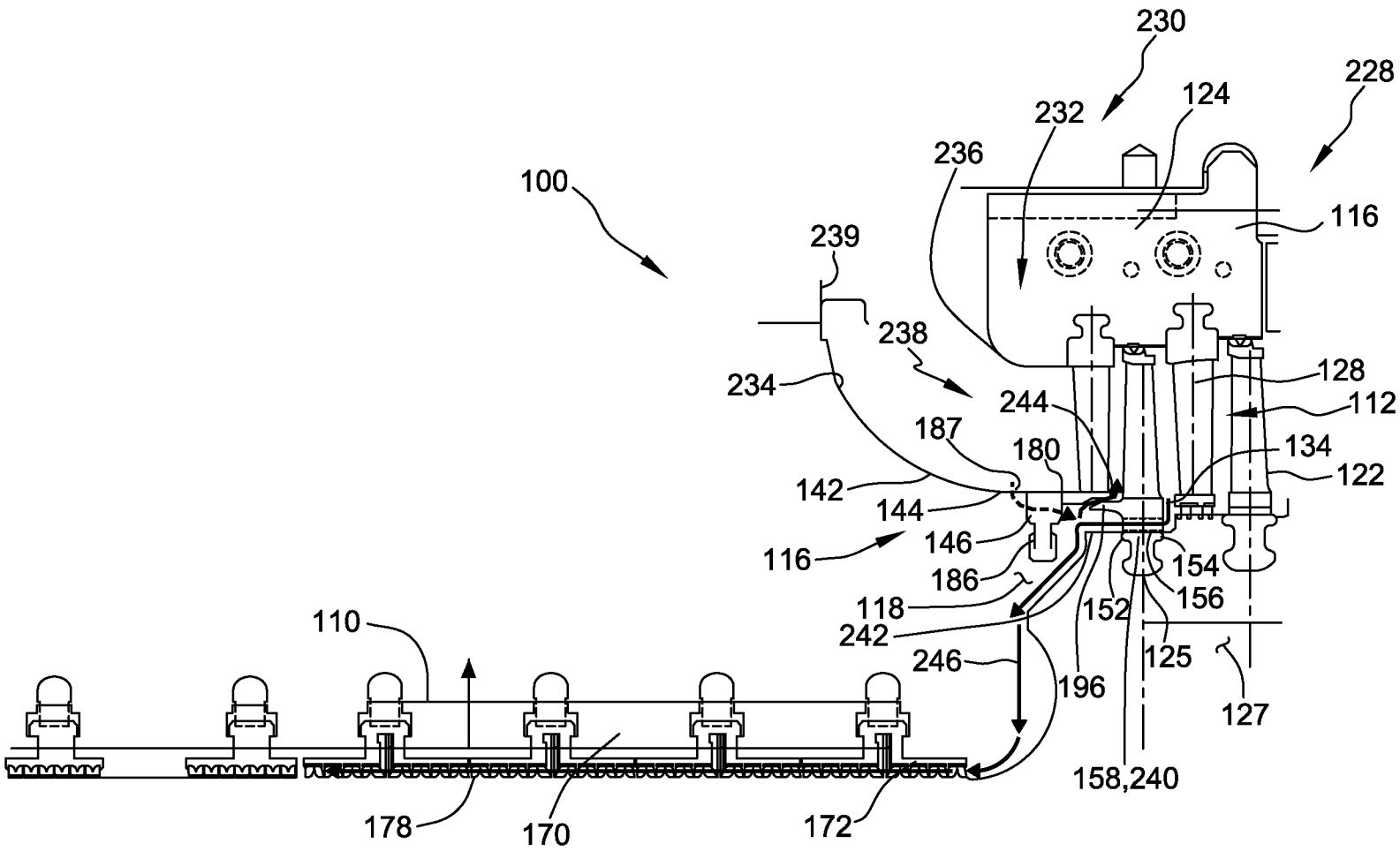
FIG. 5 is a side elevational view of another exemplary steam turbine and another exemplary flow assembly coupled to the steam turbine.

FIG. 5 is a cross sectional view another flow assembly 228 coupled to steam turbine 100. In FIG. 5, similar components include the same element numbers as FIGS. 1-4. Steam turbine 100 includes a reheat, single flow turbine having a negative root reaction configuration 230. Alternatively, steam turbine 100 may include any heat, pressure and flow configuration to enable steam turbine 100 to function as described herein. In the exemplary embodiment, steam turbine 100 includes a reheat section 232.

Stationary assembly 116 includes a steam inlet 234 coupled in flow communication to a first flow path 236. Steam inlet 234 is configured to channel or route a first steam flow 238 at high pressures and high temperatures toward first flow path 236 and in flow communication with the plurality of blades 122. In the exemplary embodiment, steam inlet 234 is located within housing 124 and is in flow communication with a steam source 239 such as, for example, a boiler or heat recovery steam generator. Steam inlet 234 further includes bowl area 142 having bowl insert 144 and leakage flow path 146.

At least one root 125 of the plurality of roots 125 includes first side 152, second side 154 and body 156 located there between. First side 152 is located upstream from second side 154 with respect to first steam flow 238. First side 152 and second side 154 are configured in flow communication to respective cooling passages 134. Root 125 further includes passageway 158 defined within body 156 and coupled in flow communication to first side 152 and second side 154. Moreover, passageway 158 is configured in flow communication to cooling passages 134. In the exemplary embodiment, passageway 158 defines a second flow path 240 within root 125. Second flow path 240 is coupled to root 125 and cooling passages 134. Moreover, second flow path 240 is configured to facilitate discharging a second steam flow 242 within root 125, through cooling passages 134 and in flow communication with angel wings 196. In the exemplary embodiment, first flow path 236 and second flow path 240 are configured in negative root reaction configuration 230.

During an exemplary operation, first steam flow 238, at high pressures and high temperatures, is directed from steam source 239, through steam inlet 234 and toward first flow path 236. More particularly, first steam flow 238 is directed toward the plurality of blades 122 and the plurality of vanes 128. As first steam flow 238 contacts the plurality of blades 122, first steam flow 238 rotates the plurality of blades 122 and rotor 118. First steam flow 238 passes through stages 112 in a downstream direction and continues through successive plurality of stages (not shown) in a similar manner.

As first steam flow 238 flows from steam inlet 234 and through first flow path 236, first steam flow 238 is configured to flow past the plurality of blades 122 and the plurality of vanes 128. Due to a negative root reaction, a temperature of first steam flow 238 at second side 154 of root 125 is different than a temperature of first steam flow 238 at first side 152. In the exemplary embodiment, the temperature at second side 154 is cooler than first side 152 of root 125 but a pressure of first steam flow 238 at second side 154 of root 125 is higher than a pressure of first steam flow 238 at first side 152 of root 125. First steam flow 238 at second side 154 of root 125 at a higher pressure than first side 152 of root 125 is used to force cooler steam as second steam flow 242 into second flow path 240. More particularly, first steam flow 238, based at least on pressure and temperature differentials on upstream and downstream sides of blades 122, is configured to back feed second steam flow 242 through second flow path 240. Second flow path 240 is configured to receive second steam flow 242 and direct second steam flow 242 within root 125 and out of first side 152 of root 125. As cooler steam of second steam flow 242 moves through second flow path 240, heat of root 125 and/or rotor body 127 is transferred to second steam flow 242 to facilitate cooling root 125 and/or rotor body 127.

A first portion 244 of second steam flow 242 exits first end 152, flows into cooling passage 134 and flow communication with angel wings 196. Angel wings 196 and/or cover 180 are configured to reduce and/or eliminate leakage of first portion 244 of second steam flow 242 that exits first end 152, flows into cooling passage 134 and mixes with first steam flow 238 in first flow path 236. Alternatively, angel wings 196 and/or cover 180 can be configured to facilitate second steam flow 242 within cooling passage 134 mixing with first steam flow 238 in first flow path 236. A second portion 246 of second steam flow 242 is configured to flow and mix with bowl insert steam flow 187 and continues to flow into third flow path 172. Second portion 246 is configured to flow through third flow path 172 and within packing head 170 for further use by a low pressure section (not shown). In the exemplary embodiment, second portion 246 moves within section 110 to facilitate controlling the pressure of steam flow across sealing members 178 to control the amount of steam leakage flowing through packing head 170.

Figure 6:
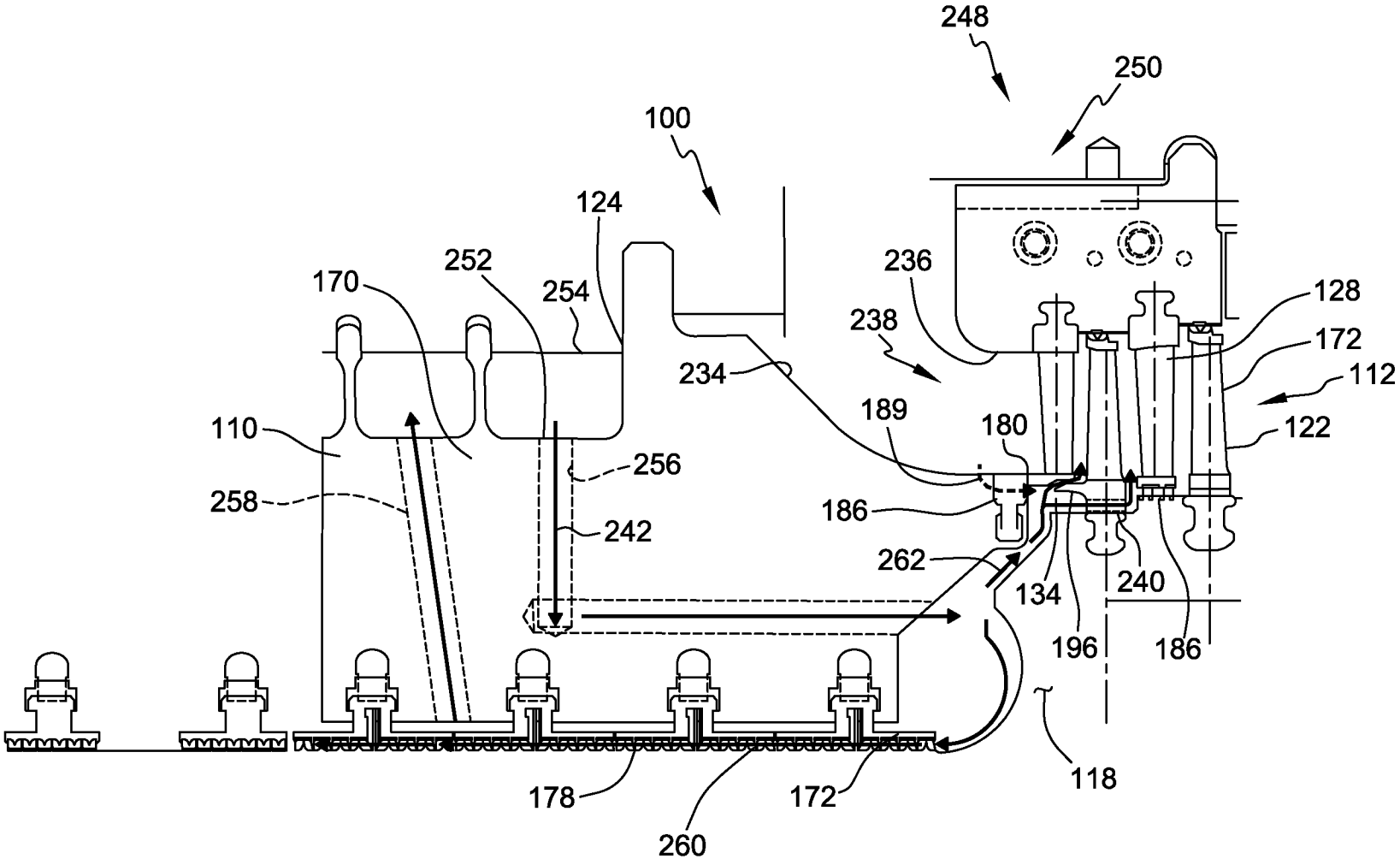
FIG. 6 is a side elevational view of another exemplary steam turbine and another exemplary flow assembly coupled to the steam turbine.

FIG. 6 is a cross sectional view another flow assembly 248 coupled to steam turbine 100. In FIG. 6, similar components include the same element numbers as FIGS. 1-5. Steam turbine 100 includes a reheat, single flow turbine having a positive cooling configuration 250. Alternatively, steam turbine 100 may include any heat, pressure and flow configuration to enable steam turbine 100 to function as described herein.

In the exemplary embodiment, steam inlet 234 is coupled in flow communication to first flow path 236. Moreover, another steam inlet 252 is coupled to housing 124 and located external to housing 124. Steam inlet 252 is coupled to another turbine component such as, for example, an external steam source 254. In the exemplary embodiment, steam inlet 252 is further coupled in flow communication to intermediate pressure section 110. More particularly, steam inlet 252 is coupled in flow communication to packing head 170. Packing head 170 includes a packing flow path 256 coupled in flow communication to steam inlet 252 and third flow path 172. Moreover, packing head 170 includes a packing bleed path 258 coupled in flow communication to third flow path 172.

During an exemplary operation, first steam flow 238, at high pressures and high temperatures, is directed from steam source, through steam inlet 234 and toward first flow path 236. More particularly, first steam flow 238 is directed toward the plurality of blades 122 and the plurality of vanes 128. As first steam flow 238 contacts the plurality of blades 122, first steam flow 238 rotates the plurality of blades 122 and rotor 118. First steam flow 238 passes through stages 112 in a downstream direction and continues through successive plurality of stages (not shown) in a similar manner.

Moreover, second steam flow 242, at lower temperatures and pressures than first steam flow 238, moves from steam inlet 252 and into packing flow path 256. Second steam flow 242 moves through packing flow path 256 and a first portion 260 moves into third flow path 172 and through packing rings 178 that are located in third flow path 172. First portion 260 moves toward intermediate pressure section 110 to facilitate controlling the pressure of steam flow across sealing members 178 to control the amount of steam leakage flowing through packing head 170. First portion 260 continues to move from third flow path 172 and into packing bleed path 258 for further use by at least one of high pressure section (not shown) and low pressure section (not shown).

A second portion 262 of second steam flow 242 moves through third flow path 172 and toward rotor 118. Second portion 262 continues to flow and mix with bowl insert steam flow 189. Second portion 262 flows between cover 180 and rotor 118 and through packing rings 186. Second steam flow 242 exits packing rings 186 and flows into cooling passage 134. Second portion 262 flows into cooling passage 134 at a pressure that is less than first steam flow 238. More particularly, second portion 262 flows between angel wings 196 and vanes 128. Angel wings 196 and/or seal 186 of cover 180 are configured to reduce and/or eliminate leakage of second steam flow 242 that flows into cooling passage 134 and mixes with first steam flow 238 in first flow path 236. Alternatively, angel wings 196 and/or seal 186 can be configured to facilitate second steam flow 242 within cooling passage 134 mixing with first steam flow 238 in first flow path 236. Second portion 262 of second steam flow 242 is also configured to flow into second flow path 240. As the cooler steam of second portion 262 moves through second flow path 240, heat of root 125 and/or rotor body 127 is transferred to second portion 262 to facilitate cooling root 125 and/or rotor body 127.

Figure 7:
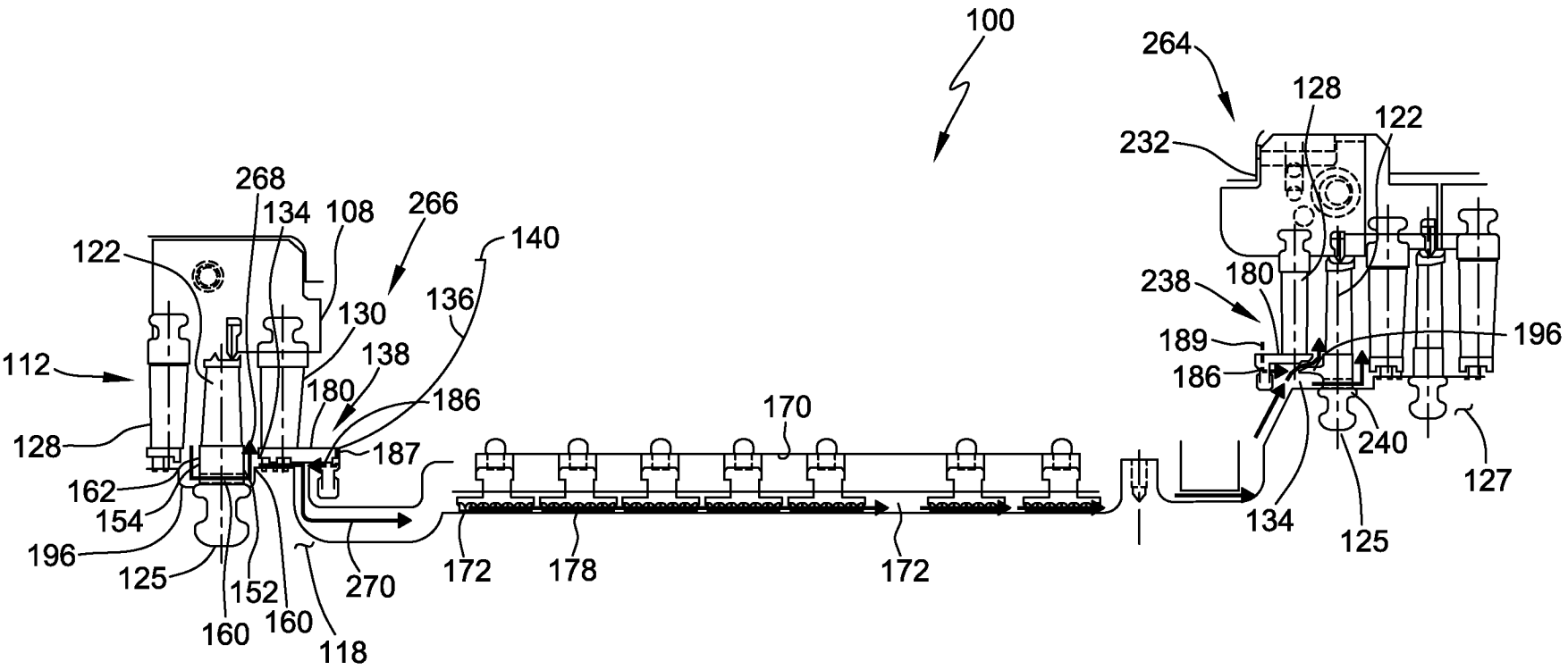
FIG. 7 is a side elevational view of another exemplary steam turbine and another exemplary flow assembly coupled to the steam turbine.

FIG. 7 is a cross sectional view another flow assembly 264 coupled to steam turbine 100. In FIG. 7, similar components include the same element numbers as FIGS. 1-6. Steam turbine 100 includes a high pressure, reheat turbine with a negative root reaction configuration 266. Alternatively, steam turbine 100 may include any heat, pressure and flow configuration to enable steam turbine 100 to function as described herein. In the exemplary embodiment, packing head 170 is coupled to high pressure section 108 and reheat section 232. More particularly, third flow path 172 is coupled in flow communication to second flow path 160 of high pressure section 108 and second flow path 240 of reheat section 232.

During an exemplary operation, first steam flow 138, at high pressures and high temperatures, is directed from steam source 140, through steam inlet 136 and toward first flow path 130. More particularly, first steam flow 138 is directed toward the plurality of blades 122 and the plurality of vanes 128. As first steam flow 138 contacts the plurality of blades 122, first steam flow 138 rotates the plurality of blades 122 and rotor 118. First steam flow 138 passes through stages 112 in a downstream direction and continues through successive plurality of stages (not shown) in a similar manner.

As first steam flow 138 flows from steam inlet 136 and through first flow path 130, first steam flow 138 is configured to flow past the plurality of blades 122 and the plurality of vanes 128. Due to a negative root reaction, a temperature of first steam flow 138 at second side 154 of root 125 is different than a temperature of first steam flow 138 at first side 152. In the exemplary embodiment, the temperature of first steam flow 138 at second side 154 is cooler than first side 152 of root 125 but pressure of first steam flow 138 at second side 154 of root 125 is higher than pressure of first steam flow 138 at first side 152 of root 125. First steam flow 138 at second side 154 of root 125 at a higher pressure than first side 152 of root 125 is used to force cooler steam as second steam flow 162 into second flow path 160. More particularly, first steam flow 138, based at least on pressure and temperature differentials on upstream and downstream sides of blades 122, is configured to back feed second steam flow 162 through second flow path 160. Second flow path 160 is configured to receive second steam flow 162 and direct second steam flow 162 within root 125. As cooler steam of second steam flow 162 moves through second flow path 160, heat of root 125 and/or rotor body 127 is transferred to second steam flow 162 to facilitate cooling root 125 and/or rotor body 127.

A first portion 268 of second steam flow 162 exits first end 152, flows into cooling passage 134. Angel wings 196 and/or seal 186 of cover 180 are configured to reduce and/or eliminate leakage of first portion 268 of second steam flow 162 that exits first end 152, flows into cooling passage 134 and mixes with first steam flow 138 in first flow path 130. Alternatively, angel wings 196 and/or seal 186 can be configured to facilitate second steam flow 162 within cooling passage 134 mixing with first steam flow 138 in first flow path 130. A second portion 270 of second steam flow 162 moves between cover 180 and rotor 118 and either through packing rings 186 or to flow and mix with bowl insert steam flow 187. Second portion 270 is configured to flow through third flow path 172 and within packing head 170 for further use by reheat section 232. In the exemplary embodiment, second portion 270 moves within intermediate pressure section 110 to facilitate controlling the pressure of steam flow across sealing members 178 to control the amount of steam leakage flowing through packing head 170.

Second portion 270 continues to flow from packing head 170 and into reheat section 232. More particularly, second portion 270 of second steam flow 162 moves through third flow path 172 and toward rotor 118. Second portion 270 continues to flow and mix with bowl insert steam flow 189. Second portion 270 flows between cover 180 and rotor 118 and through packing rings 186. Second steam flow 162 exits packing rings 186 and flows into cooling passage 134. Second portion 270 moves into cooling passage 134 at a pressure that is less than first steam flow 238. More particularly, second portion 270 flows between angel wings 196 and vanes 128 and mixes with first steam flow 238. Second portion 270 is also configured to flow into second flow path 240. As the cooler steam of second portion 270 moves through second flow path 240, heat of root 125 and/or rotor body 127 is transferred to second steam flow 162 to facilitate cooling root 125 and/or rotor body 127.

Figure 8:
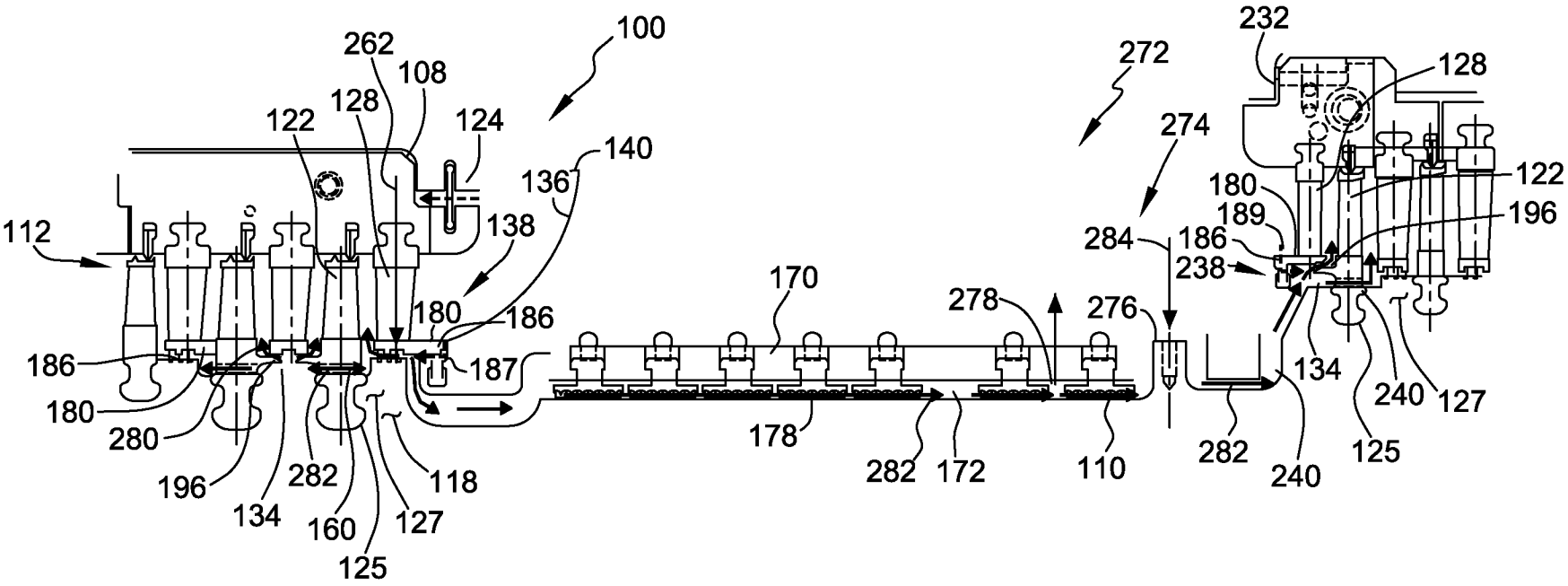
FIG. 8 is a side elevational view of another exemplary steam turbine and another exemplary flow assembly coupled to the steam turbine.

FIG. 8 is a cross sectional view of another flow assembly 272 coupled to steam turbine 100. In FIG. 8, similar components include similar element numbers as shown in FIGS. 1-7. Steam turbine 100 includes a high pressure, reheat turbine having an external cooling configuration 274. Alternatively, steam turbine 100 may include any pressure, heat and flow configuration to enable steam turbine 100 to function as described herein. In the exemplary embodiment, packing head 170 is coupled to high pressure section 108 and reheat section 232. More particularly, third flow path 172 is coupled in flow communication to second flow path 160 of high pressure section 108 and second flow path 240 of reheat section 232.

Steam inlet 136 is coupled to housing 124 and located external to housing 124. Moreover, steam inlet 136 is coupled to external steam source 140. Steam inlet 136 is configured to direct steam flow 138 from external steam source 140 and into housing 124. More particularly, steam inlet 136 is coupled in flow communication to at least one vane 128. Another steam inlet 276 is coupled in flow communication to packing head 170. In the exemplary embodiment, steam inlet 276 is further coupled to another turbine component (not shown), for example, a high pressure stage. Moreover, a bowl bleed path 278 is coupled in flow communication to third flow path 172.

During an exemplary operation, first steam flow 138, at high pressures and high temperatures, is directed from steam source 140, through steam inlet 136 and toward first flow path 130. More particularly, first steam flow 138 is directed toward the plurality of blades 122 and the plurality of vanes 128. As first steam flow 138 contacts the plurality of blades 122, first steam flow 138 rotates the plurality of blades 122 and rotor 118. First steam flow 138 passes through stages 112 in a downstream direction and continues through successive plurality of stages (not shown) in a similar manner.

Moreover, second steam flow 162, at lower temperatures and pressures than first steam flow 138, moves through vane 128. As second steam flow 162 moves through vane 128, heat of vanes 128 is transferred to second steam flow 162 to facilitate cooling vanes 128. Second steam flow 162 exits vane 128 and flows into cooling passage 134. Second steam flow 162 moves into cooling passage 134 at a pressure that is less than first steam flow 138. More particularly, a first portion 280 flows between angel wings 196 and vanes 128. Angel wings 196 and/or cover 180 are configured to reduce and/or eliminate leakage of second steam flow 162 that flows into cooling passage 134 and mixes with first steam flow 138 in first flow path 130. Alternatively, angel wings 196 and/or seal 186 can be configured to facilitate second steam flow 162 within cooling passage 134 mixing with first steam flow 138 in first flow path 130. A second portion 282 of second steam flow 162 is configured to flow into second flow path 160. As the cooler steam of second steam flow 162 moves through second flow path 160, heat of root 125 and/or rotor body 127 is transferred to second steam flow 162 to facilitate cooling root 125 and/or rotor body 127.

Second portion 282 of second steam flow 162 continues to move between cover 180 and rotor 118 and either through packing rings 186 or to flow and mix with bowl insert steam flow 187. Second steam flow 162 path is configured to flow through third flow path 172 and within packing head 170 for further use by reheat section 232. In the exemplary embodiment, second portion 282 moves to intermediate pressure section 110 to facilitate controlling the pressure of steam flow across sealing members 178 to control the amount of steam leakage flowing through packing head 170. Bowl bleed path 278 is configured to direct second portion 282 of second steam flow 162 from third flow path 172 to bowl (not shown) for bleeding steam from packing head 170.

Second portion 282 continues to flow from packing head 170 and into reheat section 232. Second portion 282 of second steam flow 162 moves through third flow path 172 and toward rotor 118. Second portion 282 continues to flow and mix with bowl insert steam flow 189. Second portion 282 flows between cover 180 and rotor 118 and through packing rings 186. Second steam flow 162 exits packing rings 186 and flows into cooling passage 134. Second steam flow 162 moves into cooling passage 134 at a pressure that is less than first steam flow 138. More particularly, second portion 282 flows between angel wings 196 and vanes 128. Angel wings 196 and/or cover 180 are configured to reduce and/or eliminate leakage of second portion 282 of second steam flow 162 that flows into cooling passage 134 and mixes with first steam flow 238 in reheat section 232. Alternatively, angel wings 196 and/or seal 186 can be configured to facilitate second portion 282 within cooling passage 134 mixing with first steam flow 238 in reheat section 232. Second portion 282 of second steam flow 162 is also configured to flow into second flow path 240. As the cooler steam of second portion 282 moves through second flow path 240, heat of root 125 and/or rotor body 127 is transferred to second steam flow 162 to facilitate cooling root 125 and/or rotor body 127. Steam inlet 276 is configured to inject cooler steam flow 284 into second portion 282 to facilitate decreasing the temperature of second steam flow 162 within reheat section 232.

Figure 9:
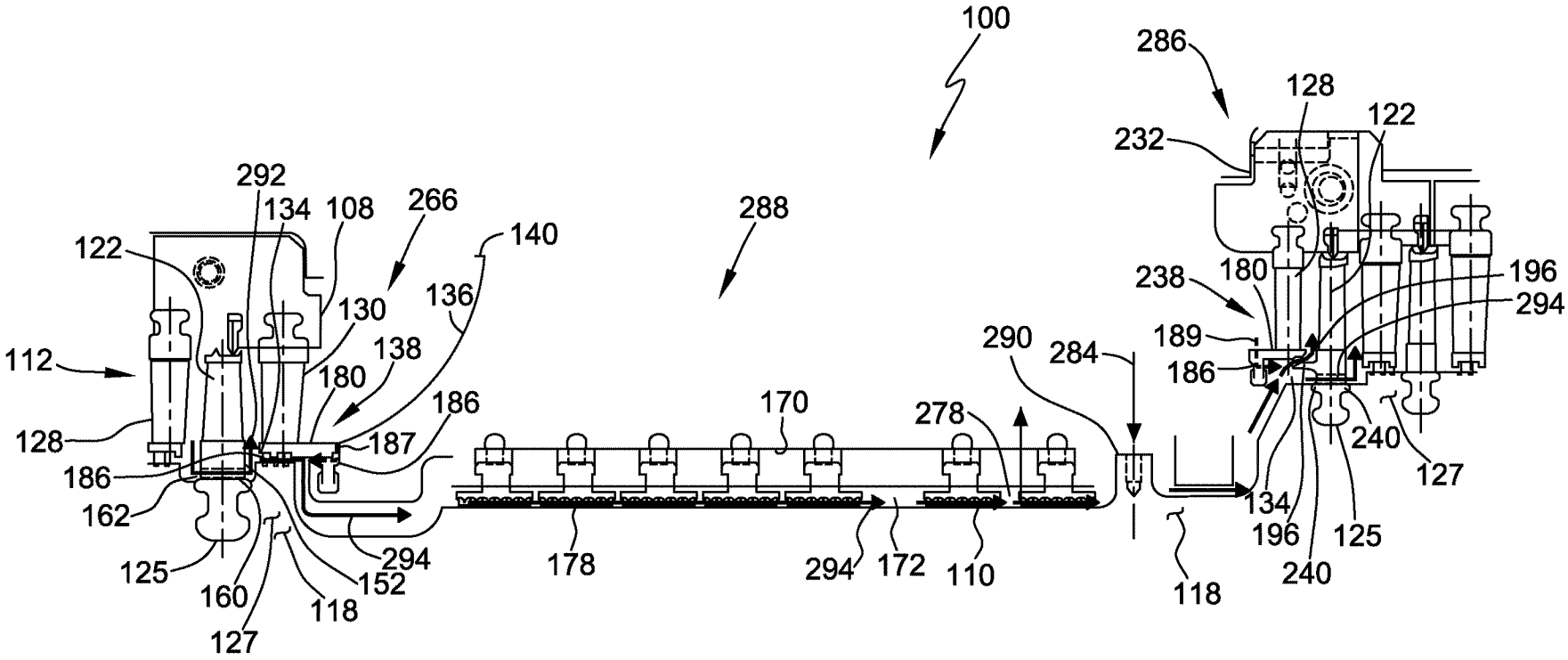
FIG. 9 is a side elevational view of another exemplary steam turbine and another exemplary flow assembly coupled to the steam turbine.

FIG. 9 illustrates a side elevational view of a steam turbine 100 and a flow assembly 286 coupled to steam turbine 100. In FIG. 9, similar components include similar element numbers as shown in FIGS. 1-8. In the exemplary embodiment, steam turbine 100 includes a high pressure, reheat turbine having a negative root reaction cooling configuration 288. Alternatively, steam turbine 100 may include any pressure and flow configuration to enable steam turbine 100 to function as described herein. In the exemplary embodiment, packing head 170 is coupled to high pressure section 108 and reheat section 232. More particularly, third flow path 172 is coupled in flow communication to second flow path 160 of high pressure section 108 and second flow path 240 of reheat section 232.

In the exemplary embodiment, steam inlet 136 is coupled in flow communication to first flow path 130. Another steam inlet 290 is coupled in flow communication to packing head 170. In the exemplary embodiment, steam inlet 290 is further coupled to another turbine component (not shown), for example, a high pressure stage. Moreover, bowl bleed path 278 is coupled in flow communication to third flow path 172.

During an exemplary operation, first steam flow 138, at high pressures and high temperatures, is directed from steam source 140, through steam inlet 136 and toward first flow path 130. More particularly, first steam flow 138 is directed toward the plurality of blades 122 and the plurality of vanes 128. As first steam flow 138 contacts the plurality of blades 122, first steam flow 138 rotates the plurality of blades 122 and rotor 118. First steam flow 138 passes through stages 112 in a downstream direction and continues through successive plurality of stages (not shown) in a similar manner.

As first steam flow 138 flows from steam inlet 136 and through first flow path 130, first steam flow 138 is configured to flow past the plurality of blades 122 and the plurality of vanes 128. Due to a negative root reaction, first steam flow 138, based at least on pressure and temperature differentials on upstream and downstream sides of blades 122, is configured to back feed second steam flow 162 through second flow path 160. Second flow path 160 is configured to receive second steam flow 162 and direct second steam flow 162 within root 125 and out of first side 152 of root 125. As cooler steam of second steam flow 162 moves through second flow path 160, heat of root 125 and/or rotor body 127 is transferred to second steam flow 162 to facilitate cooling root 125 and/or rotor body 127.

A first portion 292 of second steam flow 162 exits first end 152, flows into cooling passage 134. Angel wings 196 and/or seal 186 of cover 180 are configured to reduce and/or eliminate leakage of a first portion 292 of second steam flow 162 that exits first end 152, flows into cooling passage 134 and mixes with first steam flow 138 in first flow path 130. Alternatively, angel wings 196 and/or seal 186 can be configured to facilitate first portion 292 mixing with first steam flow 138 in first flow path 130. A second portion 294 of second steam flow 162 moves between cover 180 and rotor 118 and either through packing rings 186 or to flow and mix with bowl insert steam flow 187. Second portion 294 is configured to flow through third flow path 172 and within packing head 170 for further use by reheat section 232. In the exemplary embodiment, second portion 294 moves to intermediate pressure section 110 to facilitate controlling the pressure of steam flow across sealing members 178 to control the amount of steam leakage flowing through packing head 170. Bowl bleed path 278 is configured to direct second portion 294 from third flow path 172 to bowl (not shown) for bleeding steam from packing head 170.

Second portion 294 continues to flow from packing head 170 and into reheat section 232. Second portion 294 of second steam flow 162 moves through third flow path 172 and toward rotor 118. Second portion 294 continues to flow and mix with bowl insert steam flow 189. Second portion 294 flows between cover 180 and rotor 118 and through packing rings 186. Second portion 294 exits packing rings 186 and flows into cooling passage 134. Second portion 294 moves into cooling passage 134 at a pressure that is less than first steam flow 238. More particularly, second portion 294 flows between angel wings 196 and vanes 128. Angel wings 196 and/or cover 180 are configured to reduce and/or eliminate leakage of a second portion 294 of second steam flow 162 that flows into cooling passage 134 and mixes with first steam flow 238 in reheat section 232. Alternatively, angel wings 196 and/or cover 180 can be configured to facilitate second steam flow 162 within cooling passage 134 mixing with reheat section 232. Still further, second portion 294 of second steam flow 162 is configured to flow into second flow path 240. As the cooler steam of second portion 294 moves through second flow path 240, heat of root 125 and/or rotor body 127 is transferred to second portion 294 to facilitate cooling root 125 and/or rotor body 127. Steam inlet 290 is configured to inject cooler steam 284 into second portion 294 of second steam flow 162 to facilitate decreasing the temperature of second portion 294 within reheat section 232.

Figure 10:
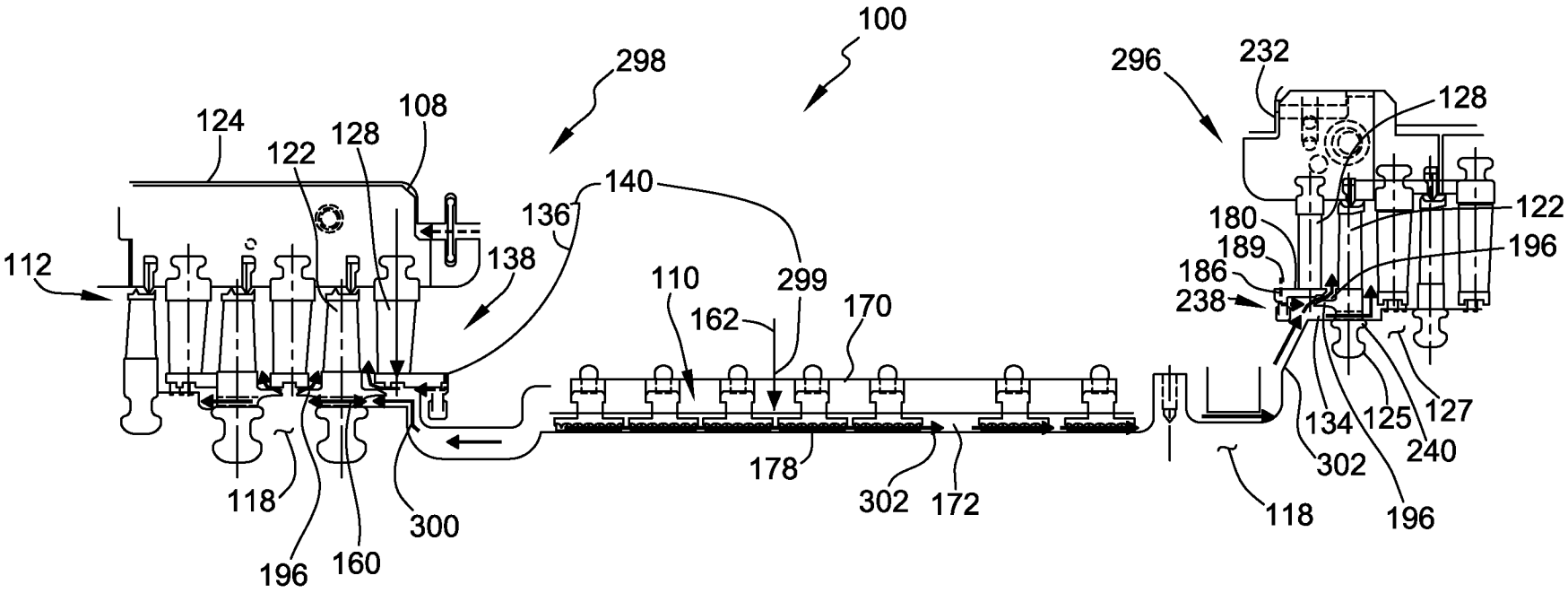
FIG. 10 is a side elevational view of another exemplary steam turbine and another exemplary flow assembly coupled to the steam turbine.

FIG. 10 illustrates a side elevational view of a steam turbine 100 and a flow assembly 296 coupled to steam turbine 100. In FIG. 10, similar components include similar element numbers as shown in FIGS. 1-9. In the exemplary embodiment, steam turbine 100 includes a high pressure, reheat turbine with an external cooling configuration 298. Alternatively, steam turbine 100 may include any pressure and flow configuration to enable steam turbine 100 to function as described herein. In the exemplary embodiment, packing head 170 is coupled to high pressure section 108 and reheat section 232. More particularly, third flow path 172 is coupled in flow communication to second flow path 160 of high pressure section 108 and second flow path 240 of reheat section 232.

In the exemplary embodiment, steam inlet 136 is coupled in flow communication to first flow path 130. Moreover, another steam inlet 299 is coupled to housing 124 and located external to housing 124. More particularly, steam inlet 299 is coupled to external steam source 140 and coupled in flow communication to intermediate pressure section 110. In the exemplary embodiment, steam inlet 299 is further coupled in flow communication to packing head 170.

During an exemplary operation, first steam flow 138, at high pressures and high temperatures, is directed from steam source 140, through steam inlet 136 and toward first flow path 130. More particularly, first steam flow 138 is directed toward the plurality of blades 122 and the plurality of vanes 128. As first steam flow 138 contacts the plurality of blades 122, first steam flow 138 rotates the plurality of blades 122 and rotor 118. First steam flow 138 passes through stages 112 in a downstream direction and continues through successive plurality of stages (not shown) in a similar manner.

Moreover, second steam flow 162, at lower temperatures and pressures than first steam flow 138, moves from steam inlet 299 and into third flow path 172. Second steam flow 162 moves through third flow path 172 and a first portion 300 moves into third flow path 172 and through packing rings 178 that are located in third flow path 172. First portion 300 continues to flow into high pressure section 108. A second portion 302 moves toward intermediate pressure section 110 to facilitate controlling the pressure of steam flow across sealing members 178 to control the amount of steam leakage flowing through packing head 170.

Second portion 302 continues to flow from packing head 170 and into reheat section 232. Second portion 302 of second steam flow 162 moves through third flow path 172 and toward rotor 118. Second portion 302 continues to flow and mix with bowl insert steam flow 189. Second portion 302 flows between cover 180 and rotor 118 and through packing rings 186. Second portion 302 exits packing rings 186 and flows into cooling passage 134. Second portion 302 moves into cooling passage 134 at a pressure that is less than first steam flow 238. More particularly, second portion 302 flows between angel wings 196 and vanes 128. Angel wings 196 and/or cover 180 are configured to reduce and/or eliminate leakage of second portion 302 of second steam flow 162 that flows into cooling passage 134 and mixes with first steam flow 238 in reheat section 232. Alternatively, angel wings 196 and/or seal 186 can be configured to facilitate second steam flow 162 within cooling passage 134 mixing with reheat section 232. Second portion 302 of second steam flow 162 is configured to flow into second flow path 240. As the cooler steam of second portion 302 of second steam flow 162 moves through second flow path 240, heat of root 125 and/or rotor body 127 is transferred to second portion 302 to facilitate cooling root 125 and/or rotor body 127.

Figure 11:
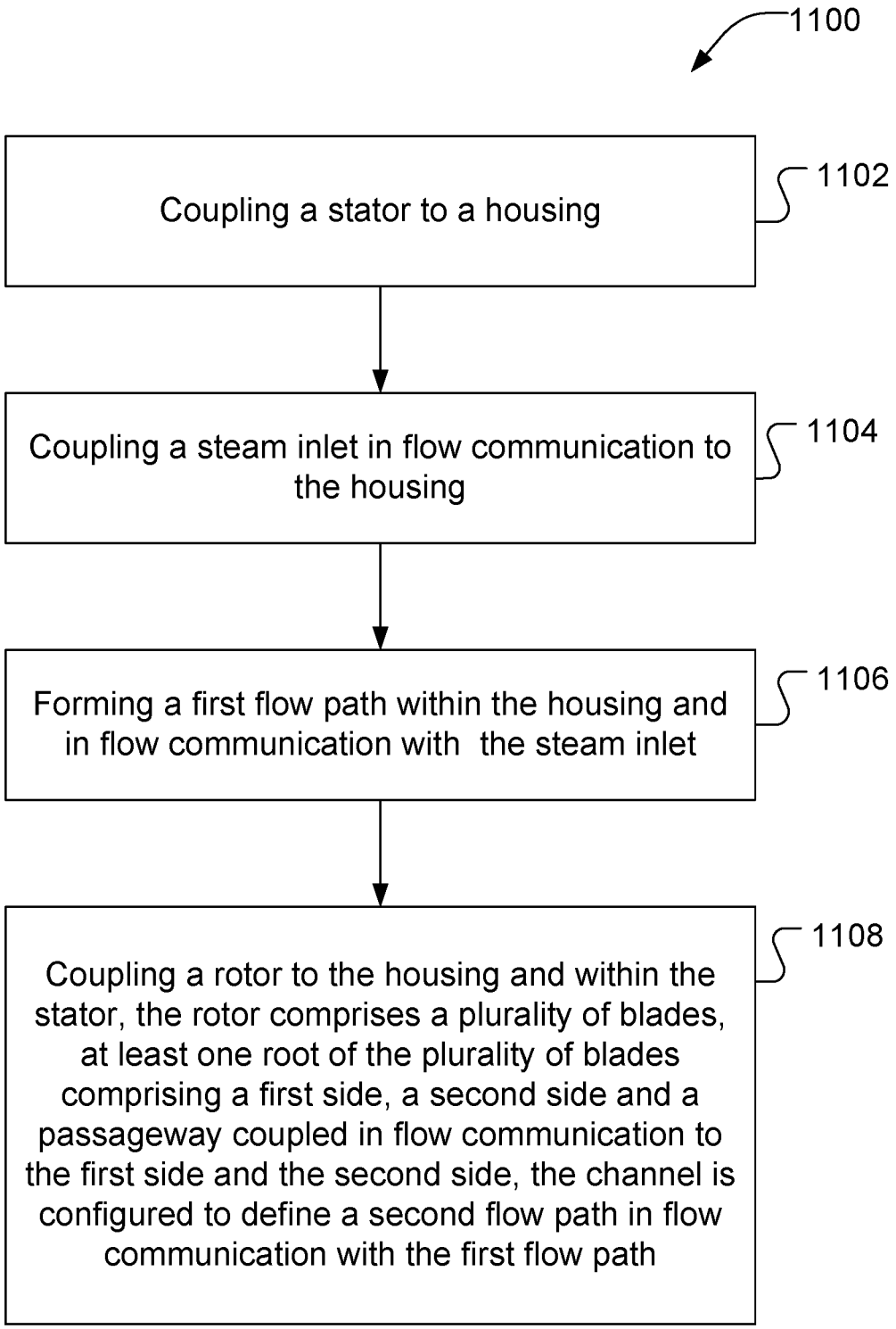
FIG. 11 is an exemplary flowchart illustrating a method of manufacturing a steam turbine.

FIG. 11 is an exemplary flowchart illustrating a method 1100 of manufacturing a steam turbine, for example steam turbine 100 (shown in FIG. 1). Method includes coupling 1102 a stator, for example stator (shown in FIG. 1), to a housing, for example housing 124 (shown in FIG. 1). A steam inlet, such as steam inlet 136 (shown in FIG. 1) is coupled 1104 in flow communication to the housing. Method 1100 includes coupling the steam inlet internal to the housing. Alternatively, method 1100 includes coupling the steam inlet external to the housing.

In the exemplary method 1100, the stator includes a plurality of vanes, for example vanes 122 (shown in FIG. 1). Method includes forming 1106 a first flow path, such as first flow path 130 (shown in FIG. 3), within the housing and in flow communication with the steam inlet. A rotor, for example rotor 118 (shown in FIG. 1), is coupled 1108 to the housing and within the stator. In the exemplary method, the rotor includes a plurality of blades, for example blades 122 (shown in FIG. 1), wherein at least one root, such as root 125 (shown in FIG. 1), of the plurality of blades includes a first side, for example first side 152 (shown in FIG. 1), a second side, for example second side 154 (shown in FIG. 1), and a passageway, for example passageway 158 (shown in FIG. 1), coupled in flow communication to the first and second sides. The passageway is configured to define a second flow path, for example second flow path 160 (shown in FIG. 1), in flow communication with the first flow path. In the exemplary method, the first and second flow paths are configured in a negative root reaction configuration, for example negative root reaction configuration 104 (shown in FIG. 1).

Method 1100 further includes coupling a seal assembly, for example seal assembly 164 (shown in FIG. 1), to the rotor and in flow communication with the second flow path. In the exemplary method 1100, the seal assembly includes a third flow path, for example third flow path 172 (shown in FIG. 1), coupled in flow communication to the second flow path. Moreover, the seal assembly includes an packing head, for example packing head 170 (shown in FIG. 1), and a plurality of packing rings, such as packing rings 178 (shown in FIG. 1).

A technical effect of the systems and methods described herein includes at least one of: directing steam flow within turbine components; cooling the turbine components; increasing the efficiency of the steam turbine; increasing the operating life of the steam turbine and decreasing at least the operating and maintenance cost of the steam turbine.

The exemplary embodiments described herein facilitate directing cooling medium along and or within a heated surface such as a turbine blade or turbine rotor of a steam turbine. The embodiments describe a cooling architecture for cooling steam turbine drum rotors. More particularly, the embodiments describe cooling the rotor and dovetail region as this region experiences heat effects such as, but not limited to, creep rupture. Within a bucket-rotor interface, the cooling effect of the exemplary embodiments is directed toward the rotor body portion of the dovetail joint as rotor materials can have less creep capability than bucket materials. The embodiments described herein use a first flow path and a second flow path within to enhance heat transfer effectiveness. Moreover, the embodiments described herein facilitate increasing turbine efficiency and/or output and/or temperature capabilities while reducing operational and maintenance costs associated with the turbine. Still further, the embodiments described herein enhance component life and facilitate refurbishment of parts. The first and second flow path improve steam flow cooling for a plurality of turbine sections such as, for example, high pressure sections, intermediate pressure sections, reheat sections and/or low pressure sections.

Exemplary embodiments of a turbine component and methods for assembling the turbine component are described above in detail. The methods and systems are not limited to the specific embodiments described herein, but rather, components of systems and/or steps of the methods may be utilized independently and separately from other components and/or steps described herein. For example, the methods may also be used in combination with other manufacturing systems and methods, and are not limited to practice with only the systems and methods as described herein. Rather, the exemplary embodiment can be implemented and utilized in connection with many other thermal applications.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A steam turbine comprising:

a housing;

a first steam inlet coupled in flow communication to said housing and configured to discharge a first steam flow within said housing;

a second steam inlet configured to provide a second steam flow;

a stator coupled to said housing and comprising a plurality of vanes; and a rotor coupled to said housing and located within said stator, said rotor and said stator are configured to form a first flow path therebetween and in flow communication with said first steam flow, said rotor comprising a plurality of blades coupled to said rotor, each of said plurality of blades comprising at least one root comprising a first side, a second side and a passageway coupled in flow communication to said first side and said second side, said passageway is configured to receive the second steam flow within said at least one root, each of said plurality of blades comprises a first angel wing comprising a first overlapping portion, and a second angel wing comprising a second overlapping portion, said first overlapping portion releasably coupled to said second overlapping portion, said first and second angel wings configured to seal the second steam flow from said first flow path, said first angel wing extending from said first side of said at least one root of a first of said plurality of blades, said second angel wing extending from said second side of said at least one root of a second of said plurality of blades.

2. The steam turbine of claim 1, wherein said second steam flow comprises a temperature that is different than said first steam flow.

3. The steam turbine of claim 1, wherein said first steam inlet is coupled in flow communication with said first flow path and located within said housing.

4. The steam turbine of claim 1, wherein said second steam inlet is located external to said housing.

5. The steam turbine of claim 1, wherein said second steam inlet is coupled in flow communication to at least one vane of said plurality of vanes.

6. The steam turbine of claim 5, wherein said at least one vane comprises a first end, a second end and a radial flow path coupled in flow communication to said first end and to said second end, said first end is coupled in flow communication to said second steam inlet and said second end is coupled in flow communication to said passageway.

7. The steam turbine of claim 1, wherein said rotor comprises a third flow path coupled in flow communication with the second steam flow.

8. The steam turbine of claim 1, wherein said rotor comprises a third flow path coupled in flow communication with the second steam flow and a packing head coupled in flow communication to said third flow path.

9. The steam turbine of claim 1, wherein said housing comprises a high pressure multi-stage arrangement.

10. The steam turbine of claim 1, wherein said at least one root comprises an axial dovetail configuration.

11. A rotor assembly coupled to a housing and located within a stator of a steam turbine, said rotor assembly comprising:

a rotor coupled to the housing and comprising a first flow path configured to receive a first steam flow;

a plurality of blades coupled to said rotor, each blade of said plurality of blades comprising at least one root comprising a first side, a second side and a passageway coupled in flow communication to said first side and said second side, said passageway is configured to receive a second steam flow, each of said plurality of blades comprises a first angel wing comprising a first overlapping portion, and a second angel wing comprising a second overlapping portion, said first overlapping portion releasably coupled to said second overlapping portion, said first and second angel wings configured to seal the second steam flow from said first flow path, said first angel wing extending from said first side of said at least one root of a first of said plurality of blades, said second angel wing extending from said second side of said at least one root of a second of said plurality of blades.

12. The rotor assembly of claim 11, further comprising a first steam inlet coupled in flow communication to said first flow path and located within said housing.

13. The rotor assembly of claim 12, further comprising a second steam inlet coupled in flow communication to said passageway and located external to said housing, said second steam inlet configured to provide the second steam flow.

14. The rotor assembly of claim 12, further comprising a second steam inlet coupled in flow communication to at least one vane of said plurality of vanes, said second steam inlet configured to provide the second steam flow.

15. The rotor assembly of claim 11, wherein said blade comprise an axial dovetail configuration.

16. The rotor assembly of claim 11, wherein said rotor assembly comprises a third flow path in flow communication with the second steam flow.

17. A method of assembling a steam turbine, said method comprising:

coupling a stator to a housing;

coupling a first steam inlet in flow communication to the housing;

forming a first flow path within the housing and in flow communication with the first steam inlet;

configuring a second steam inlet to provide a second steam flow; and coupling a rotor to the housing and within the stator, the rotor comprises a plurality of blades, each blade of the plurality of blades including at least one root having a first side, a second side and a passageway coupled in flow communication to the first side and the second side, the passageway is oriented to receive the second steam flow within the at least one root, each of the plurality of blades includes a first angel wing including a first overlapping portion and a second angel wing including a second overlapping portion, said first overlapping portion releasably coupled to the second overlapping portion, said first and second angel wings configured to seal the second steam flow from the first flow path, the first angel wing extending from the first side of the at least one root of a first of the plurality of blades and the second angel wing extending from the second side of the at least one root of a second of the plurality of blades.

18. The method of claim 17, wherein configuring the second steam inlet comprises locating the second inlet external to the housing.

19. The method of claim 17, wherein configuring the second steam inlet comprises coupling the second steam inlet in flow communication to the stator.

* * * * *